US009204228B2

(12) United States Patent
Chan et al.

(10) Patent No.: US 9,204,228 B2
(45) Date of Patent: Dec. 1, 2015

(54) HEARING INSTRUMENT WITH PLUG-IN SOUND TUBE CONNECTION, CORRESPONDING CASE AND SOUND TUBE

(71) Applicant: SIVANTOS PTE. LTD., Singapore (SG)

(72) Inventors: Mo Choong Marie Chan, Singapore (SG); Wee Haw Koo, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 299 days.

(21) Appl. No.: 13/867,624

(22) Filed: Apr. 22, 2013

(65) Prior Publication Data

US 2013/0279728 A1 Oct. 24, 2013

(30) Foreign Application Priority Data

Apr. 20, 2012 (DE) ..... 10 2012 206 588

(51) Int. Cl.
*H04R 25/00* (2006.01)

(52) U.S. Cl.
CPC ..... *H04R 25/608* (2013.01); *H04R 25/604* (2013.01); *H04R 25/75* (2013.01); *H04R 2225/63* (2013.01)

(58) Field of Classification Search
CPC .... H04R 25/60; H04R 25/604; H04R 25/608; H04R 25/65; H04R 25/658; H04R 2225/02; H04R 2225/63
USPC ..... 381/312, 322–331
See application file for complete search history.

(56) References Cited

U.S. PATENT DOCUMENTS

| | | | | |
|---|---|---|---|---|
| 3,812,300 | A | 5/1974 | Brander et al. | |
| 5,018,980 | A * | 5/1991 | Robb | 439/8 |
| 7,822,218 | B2 * | 10/2010 | Van Halteren | 381/324 |
| 2008/0002848 | A1 * | 1/2008 | Heerlein et al. | 381/328 |
| 2008/0087349 | A1 * | 4/2008 | Holtz | 138/118 |
| 2008/0260192 | A1 | 10/2008 | Yanz et al. | |
| 2010/0027825 | A1 | 2/2010 | Fickweiler et al. | |
| 2011/0211716 | A1 | 9/2011 | Cheng et al. | |
| 2011/0255723 | A1 | 10/2011 | Obradovic et al. | |

FOREIGN PATENT DOCUMENTS

| | | | |
|---|---|---|---|
| DE | 102006004033 | A1 | 8/2007 |
| DE | 102006029819 | A1 | 1/2008 |
| EP | 1983802 | A2 | 10/2008 |
| EP | 2152025 | A1 | 2/2010 |
| EP | 2373061 | A1 | 10/2011 |

* cited by examiner

*Primary Examiner* — Ahmad F Matar
*Assistant Examiner* — Katherine Faley
(74) *Attorney, Agent, or Firm* — Laurence Greenberg; Werner Stemer; Ralph Locher

(57) ABSTRACT

A hearing instrument contains a case and a sound tube. The instrument has a case/tube connection that is simple, easy to assemble, and can be established and released in a reversible manner. The hearing instrument has a case in which a receiver is disposed, and a sound tube for conveying output signals. Disposed in the case is a mounting insert having a receiver compartment and a socket. The receiver is inserted in the receiver compartment and the socket has a circumferential recess or ridge. The sound tube has a plug with a ridge or recess corresponding to the circumferential recess or ridge of the socket. The socket and plug can be reversibly interconnected and detached. The mounting insert obviates the need for an additional sound-conducting connecting piece between receiver and sound tube. This reduces the component count and improves a seal-tightness of the connection between receiver and sound tube.

17 Claims, 4 Drawing Sheets

HEARING INSTRUMENT WITH PLUG-IN SOUND TUBE CONNECTION, CORRESPONDING CASE AND SOUND TUBE

CROSS-REFERENCE TO RELATED APPLICATION

This application claims the priority, under 35 U.S.C. §119, of German application DE 10 2012 206 588.1, filed Apr. 20, 2012; the prior application is herewith incorporated by reference in its entirety.

BACKGROUND OF THE INVENTION

Field of the Invention

The invention relates to a hearing instrument, in particular a BTE hearing system, having a case and a sound tube connected to the case by a plug-in connection, and to a sound tube having a corresponding plug and a case having a corresponding socket.

Hearing instruments can be implemented, for example, as hearing aids. A hearing aid is used to supply a hearing-impaired person with ambient acoustic signals which are processed and amplified to compensate or treat the respective hearing impairment. It basically consists of one or more input transducers, a signal processing device, an amplifying device, and an output transducer. The input transducer is generally a sound pickup device, e.g. a microphone, and/or an electromagnetic pickup such as an induction coil. The output transducer is generally implemented as an electroacoustic transducer, e.g. a miniature loudspeaker, or as an electromechanical transducer such as a bone conduction receiver. It is also known as an earpiece. The output transducer generates output signals which are conveyed to the patient's ear and are configured to produce an auditory perception in the patient. The amplifier is generally incorporated in the signal processing device. The hearing aid is powered by a battery integrated into the hearing aid case. The essential components of a hearing aid are generally mounted on a printed circuit board as a substrate or are connected thereto.

As well as being used as hearing aids, hearing instruments can also be configured as so-called tinnitus maskers. Tinnitus maskers are used to treat tinnitus sufferers. They generate acoustic output signals as a function of the respective hearing impairment and, depending on operating principle, also as a function of the ambient noise. These signals can help to reduce the perception of annoying tinnitus or other ear noise.

Hearing instruments can also be designed as telephones, cell phones, headsets, headphones, MP3 players or other telecommunications or entertainment electronics systems.

In the following description, the term hearing instrument shall be taken to include not only hearing aids, but also tinnitus maskers and other comparable devices as well as telecommunications or entertainment electronics systems.

Hearing systems, in particular hearing aids, are known in different basic case configurations. In the case of behind-the-ear (BTE) hearing aids, a case (housing) containing components such as a battery and signal processing device is worn behind the ear and a flexible sound tube conveys the acoustic output signals of a receiver from the case to the ear canal where an ear-mold is often provided on the tube for reliable positioning of the tube end.

The common aim of all case configurations is to make the cases as small as possible in order to increase wearing comfort and reduce the visibility of the hearing aid for cosmetic reasons.

In conventional BTE hearing instruments, the receiver is retained in the case, possibly decoupled therefrom in respect of vibrations, and connected to the sound output of the case by a connecting piece. The sound tube which conveys the output signals of the receiver to the ear of the hearing instrument wearer is connected to the sound output of the case. The connecting piece can be mounted, for example, in the case or in a frame disposed in the case.

U.S. patent publication No. 2011/0255723 A1 discloses a BTE hearing aid in which the receiver is disposed in the ear canal (also known as an RIC-BTE hearing aid). The receiver is disposed in an earpiece where it is connected to a sound tube.

U.S. Pat. No. 3,812,300 discloses the compliant mounting of a receiver which decouples the receiver disposed in a case from the case in respect of vibrations. The compliant support also enables the receiver to be connected to a tube or sound channel.

SUMMARY OF THE INVENTION

The object of the invention is to disclose a hearing instrument containing a case and sound tube, the instrument having a simple, easy to assemble case/tube connection that is soundproof, dirt-proof and moisture-proof and can be easily closed and released in a reversible manner.

The object is inventively achieved by a hearing instrument and by a corresponding case and a corresponding sound tube having the features set forth in the independent claims.

For a hearing instrument containing a case in which a receiver is disposed, and containing a sound tube for conveying output signals of the receiver into an ear canal, a basic concept of the invention is that there is disposed in the case a mounting insert having a receiver compartment and a socket. The receiver is inserted into the receiver compartment. The socket has a circumferential recess or ridge, and the sound tube has a plug with a ridge or recess corresponding to the circumferential recess or ridge of the socket, and the socket and plug are configured such that the plug is reversibly insertable in and removable from the socket.

Further basic concepts of the invention consist in a correspondingly configured sound tube and a correspondingly configured case.

The mounting insert obviates the need for an additional sound-conducting connecting piece between the receiver and the sound tube. This reduces the number of components of the hearing instrument, which is advantageous in terms of assembly complexity, the logistical overhead involved in providing the hearing instrument components and the maintenance required, and helps to reduce the size of the hearing instrument. Moreover, eliminating an additional connecting piece is advantageous for the sound proofness of the connection between the receiver and the sound tube. It also advantageously facilitates replacement of the sound tube. The design of the socket and plug with corresponding circumferential recesses and ridges creates a detent for the plug-in connection which is easy to use without any additional tool and is readily and intuitively understandable. The term corresponding is to be understood as meaning that the plug has a ridge fitting into a recess of the socket or conversely a recess fitting over a ridge of the socket. The circumferential design also enables the plug to rotate with respect to the socket, thereby improving the individual tailoring of the hearing instrument to the ear and head shape of the hearing instrument wearer. Not least, the arrangement of the mounting insert and socket in the hearing instrument case allows externally invisible or barely visible placement of the plug-in connection, which is cosmetically advantageous.

An advantageous embodiment consists in that the mounting insert is of one-piece design, thereby minimizing the component count of the hearing instrument as well as the number of assembly steps. In addition, with a one-piece embodiment variant a seamless and therefore particularly sound-proof connection between the receiver and the sound tube can be created.

Another advantageous embodiment is that at least one of the components plug and mounting insert is formed from at least partly of a flexible material. A flexible material provides mechanical stability while allowing reversible establishment and release of the plug-in connection. Moreover, flexible material is advantageous for providing a connection that is sound-proof as well as moisture-poof and dirt-proof. Flexible material is also well suited for vibration decoupling of receiver and case.

Another advantageous embodiment consists in that, when the plug is inserted in the socket, the plug-in connection between the socket and the plug creates a seal for sound in the frequency range audible to the human ear, in particular in the 20 Hz to 20 kHz range. This frequency range is of particular interest, since the output signals of the receiver are in this very range.

Another advantageous embodiment consists in that the mounting insert is configured such that it damps vibrations transmitted from the receiver to the case and vice versa. The mounting insert therefore incorporates another function in addition to supporting the receiver and creating a plug-in connection to the sound tube. This higher degree of integration has advantageous implications for the component count of the hearing instrument and therefore also for maintenance and logistics, and for the size of the hearing instrument.

Another advantageous embodiment consists in that the receiver compartment is configured such that the receiver is retained by the receiver compartment, and that the receiver can be reversibly inserted into and removed from the receiver compartment, thereby facilitating assembly, maintenance and replacement of the receiver.

Another advantageous embodiment consists in that the mounting insert has a collar, that the case has a holder corresponding to the collar, and that the mounting insert is retained in the case by the collar inserted in the holder. This allows simple and mechanically stable retention of the mounting insert in the case and enables the insert to be inserted and replaced with minimal assembly effort. As the sound tube is also inserted in the mounting insert by use of the plug and retained there in a mechanically stable manner, this therefore also ensures mechanically stable retention of the sound tube in the case.

Another advantageous embodiment consists in that the collar is disposed in the region of the socket. As a result, the mounting insert region in which the receiver compartment and therefore the receiver is disposed is not in direct contact with the holder in the case. Instead, the receiver compartment region can be disposed without direct contact with the case. This helps to prevent vibration transmission between case and receiver.

Another advantageous embodiment consists in that the plug with the sound tube is produced in one piece by multi-component injection molding or by insert molding. Multi-component injection molding is to be understood as meaning a conventional process in which the components sound tube and plug are produced either simultaneously in a merging manner or sequentially, wherein the component produced second is injected onto the component produced first. Insert molding is to be understood as meaning a conventional injection molding process in which one of the components sound tube and plug is produced, and then the second component is injected onto the first produced component. Both multi-component injection molding and insert molding allow rational production of complex one-piece parts, thereby obviating the need for an additional separate plug and reducing the number of hearing instrument components. The reduced component count is advantageous in terms of assembly effort, maintenance and logistics and also in terms of the size of the plug/sound tube arrangement.

Another advantageous embodiment consists in that the plug and socket each have at least two circumferential recesses or ridges. This produces a higher mechanical stability of the plug-in connection between plug and socket as well as better seal-tightness.

Other features which are considered as characteristic for the invention are set forth in the appended claims.

Although the invention is illustrated and described herein as embodied in a hearing instrument with plug-in sound tube connection, a corresponding case and a sound tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
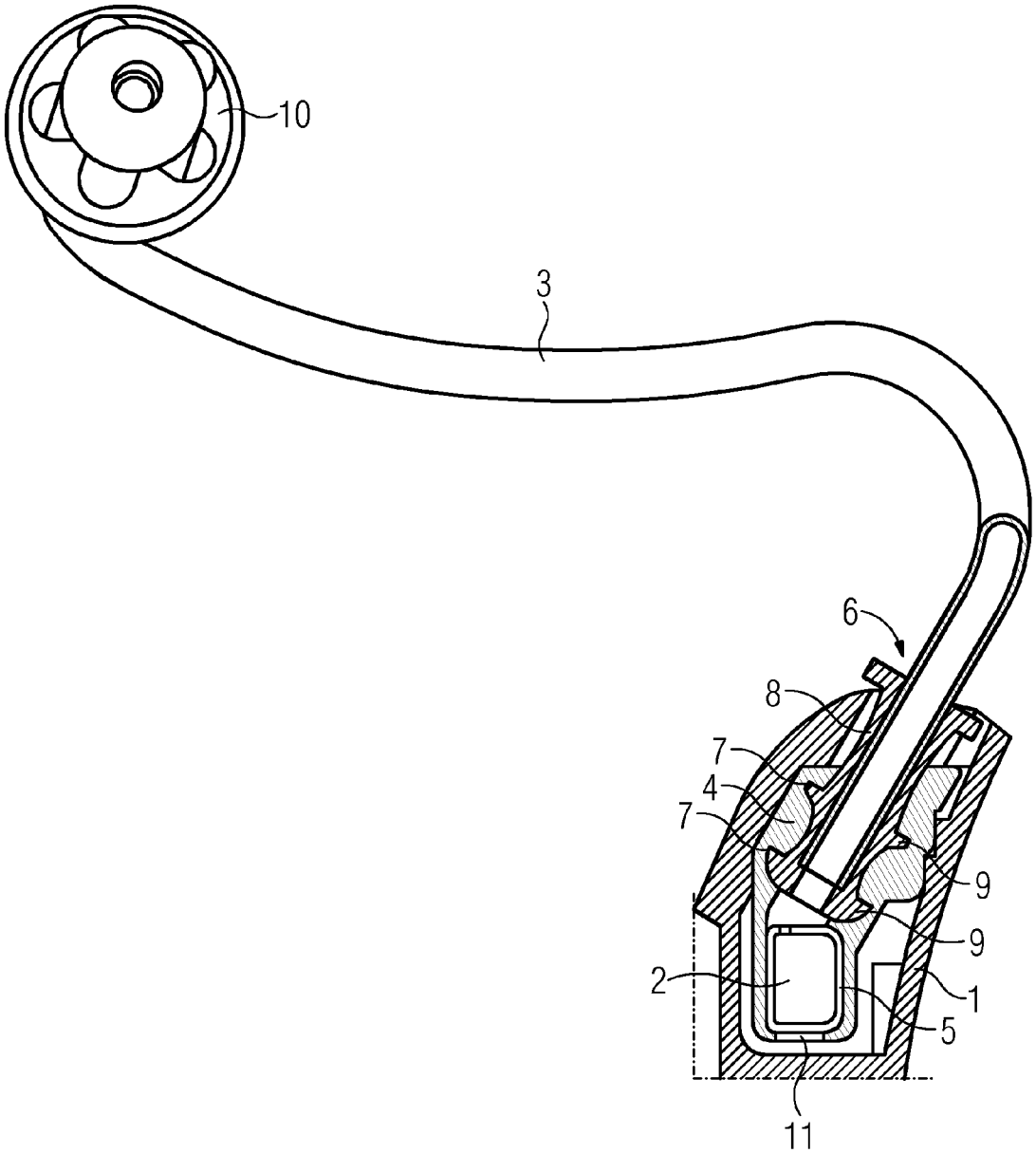
FIG. 1 is a diagrammatic, sectional view of a plug-in connection of a hearing instrument between a sound tube and a case according to the invention.

Referring now to the figures of the drawing in detail and first, particularly, to FIG. 1 thereof, there is shown a schematic sectional view of a plug-in connection between a sound tube 3 and a case 1 of a hearing instrument. The case 1 is shown merely as a case section. A plug-in connection is constituted by a plug 8 and a socket 6 according to the invention.

On an end of the sound tube 3 intended to be worn in an ear canal is an ear-mold 10 which is configured as a so-called dome. On the other end of the sound tube 3 facing the case 1 of the hearing instrument is the plug 8. This is inserted in the socket 6 of the case 1.

The plug 8 is over-molded in one piece on the sound tube 3 or rather injection molded in one piece therewith. The sound tube 3 consists of a material conventionally used for the purpose, as is the plug 8. In order to achieve the mechanical properties required in each case, different materials can be used for the sound tube 3 and the plug 8, which materials can be processed, for example, in a multi-component injection molding process.

The plug 8 has a rotationally symmetrical cross section along its longitudinal axis. At its case end and in the vicinity thereof it has a circumferential ridge 9 which is used to lock the plug 8 in the socket in a mechanically stable manner. The ridges 9 resembling circumferential sealing lips have a degree of flexibility allowing manual insertion and removal of the plug 8, but at the same time ensuring sufficient stability of the plug-in connection to prevent accidental removal.

Inserted into the case section 1 is a mounting insert 4 whose output-side section constitutes the socket 6. In the socket 6, which has an opening that is rotationally symmetrical along its longitudinal axis, circumferential recesses 7 are formed inside the opening.

The recesses 7 are shaped so as to accommodate the circumferential ridges 9 of the plug 8, thereby locking the plug 8 into the socket 6 and, due to the mutual engagement of the recesses 7 and ridges 9, securing it against accidental release. The recesses 7 and ridges 9 as well as the rest of the plug 8 and the rest of the socket 6 are in contact with one another such that the plug-in connection is sealed against the ingress of moisture and dirt as well as against the passage of sound, in particular in the frequency range of e.g. 20 Hz to 20 kHz perceptible to the human ear. This seal-tightness is created by the surface constitution of the plug 8 and socket 6 and by the flexibility or rather elasticity thereof.

On the side opposite the socket 6, a receiver compartment 5 is provided in the mounting insert 4. A receiver 2 is inserted in the receiver compartment 5. In order to be able to insert and also possibly remove the receiver 2, the receiver compartment 5 has an opening 11. The material of the mounting insert 4 is constituted, at least in the region of the receiver compartment 5, such that the transmission of vibrations from the receiver 2 to the case 1 and vice versa is prevented or at least reduced. This vibration decoupling of the receiver 2 from the case 1 is important among other things in order to improve the acoustic characteristics of the hearing instrument and in particular make it less prone to feedback caused by structure-borne noise transmitted via the case 1.

The two sections of the mounting insert 4 in which the socket 6 and the receiver compartment 5 are respectively implemented are seamlessly integrated in one piece. Between the receiver compartment 5 and the socket 6, a sound passage opening is implemented through which sound generated by the receiver 2 is conveyed into the inserted sound tube 3. This seamless one-piece design of the mounting insert 4 enables the sound tube 3 to be connected simply and particularly tightly to the output of the receiver 2.

Figure 2:
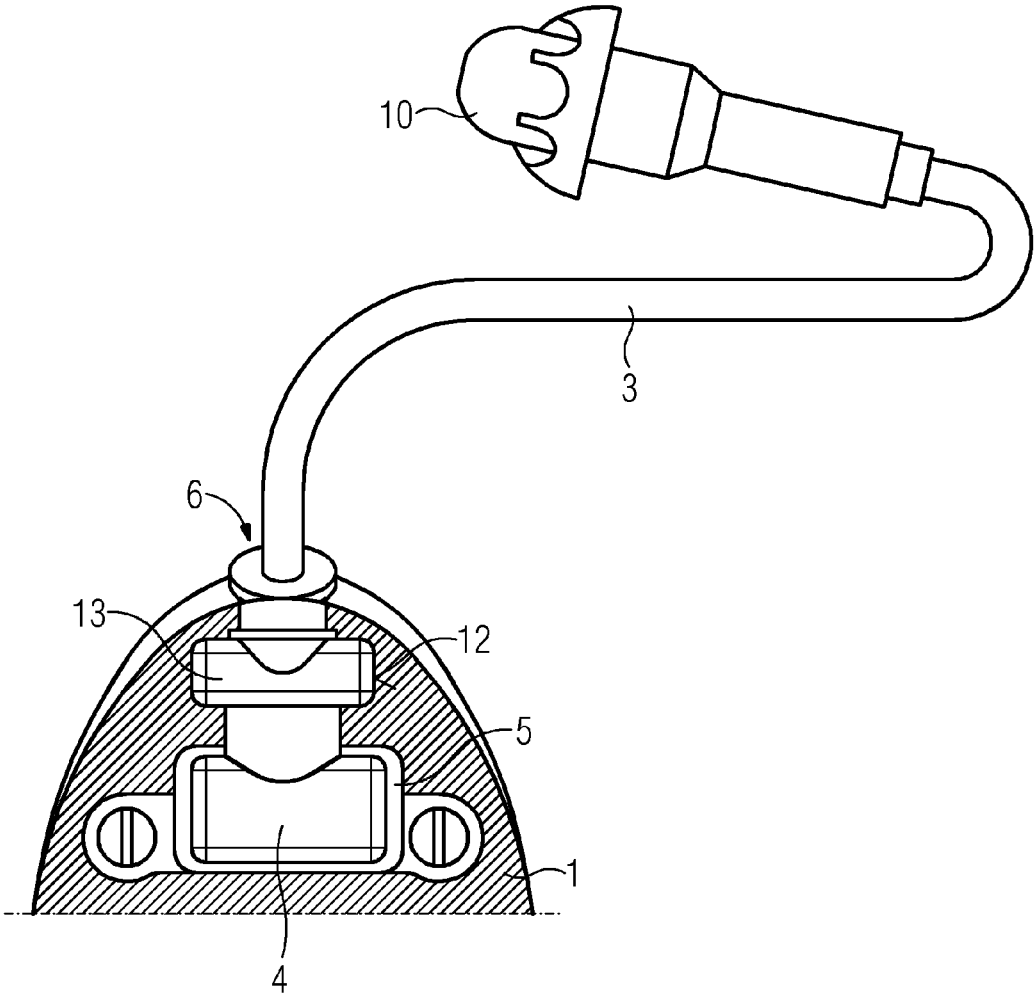
FIG. 2 is a sectional view showing a mounting insert.

FIG. 2 shows a schematic sectional view of the mounting insert 4 in the case 1 with the sound tube 3 connected. As above, the case 1 is shown only sectionally. As explained above, the sound tube 3 with the ear-mold 10 is inserted into the socket 6 of the case 1 or rather of the mounting insert 4 by the plug 8 (not shown). In respect of a description of the plug-in connection, reference is made to the above explanations.

The perspective of the drawing is rotated through 90° compared to the previous depiction. In this perspective it can be seen that the mounting insert 4 has a collar 13 on the output side. The collar 13 is inserted in a correspondingly shaped holder 12 of the case 1. The mounting insert 4 is retained in the case 1 by the mutual engagement of the collar 13 and the holder 12.

The collar 13 is located in the region of the section of the mounting insert 4 in which the socket 6 is implemented. The opposite section in which the receiver compartment 5 is implemented is not in direct contact with the case 1. Rather, the section with the receiver compartment 5 is disposed in a floating manner in the case 1, and is retained in the socket-side section of the mounting insert 4 solely by the collar 13. In this way, structure-borne noise bridges between the receiver and the case 1 are minimized, thereby assisting the vibration decoupling of the case 1 and the receiver.

Figure 3:
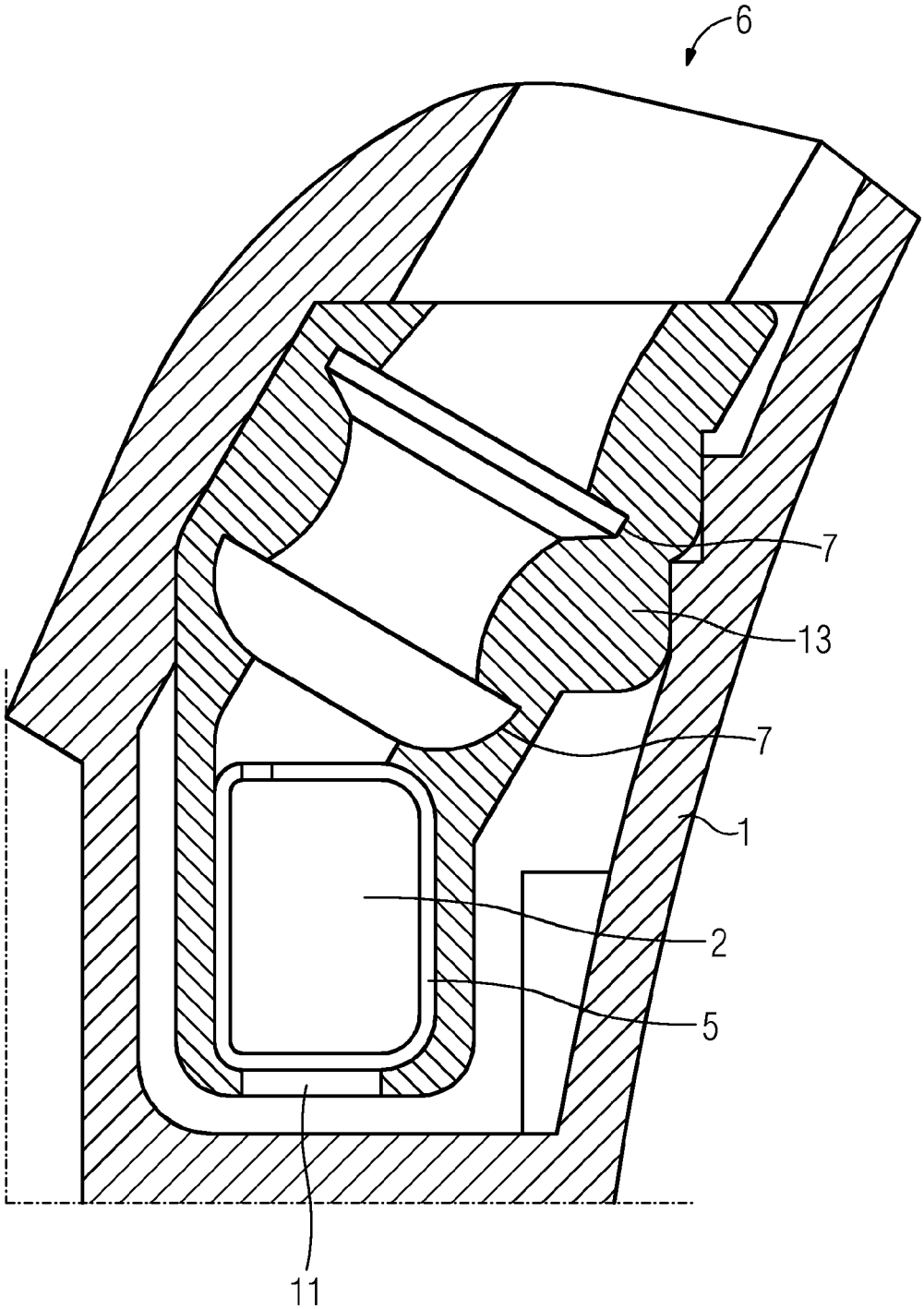
FIG. 3 is an enlarged, sectional view of the mounting insert.

FIG. 3 shows a schematic sectional view of the mounting insert 4 in the case 1 without the plug 8 and the sound tube 3. The receiver 2 is inserted in the receiver compartment 5 through the opening 11 provided for the purpose. The output of the receiver 2 leads directly into the socket 6 via the sound passage opening described above. Visible in the socket 6 are the circumferential recesses 7 which are used to lock in place and seal a plug (not shown in the drawing).

Figure 4:
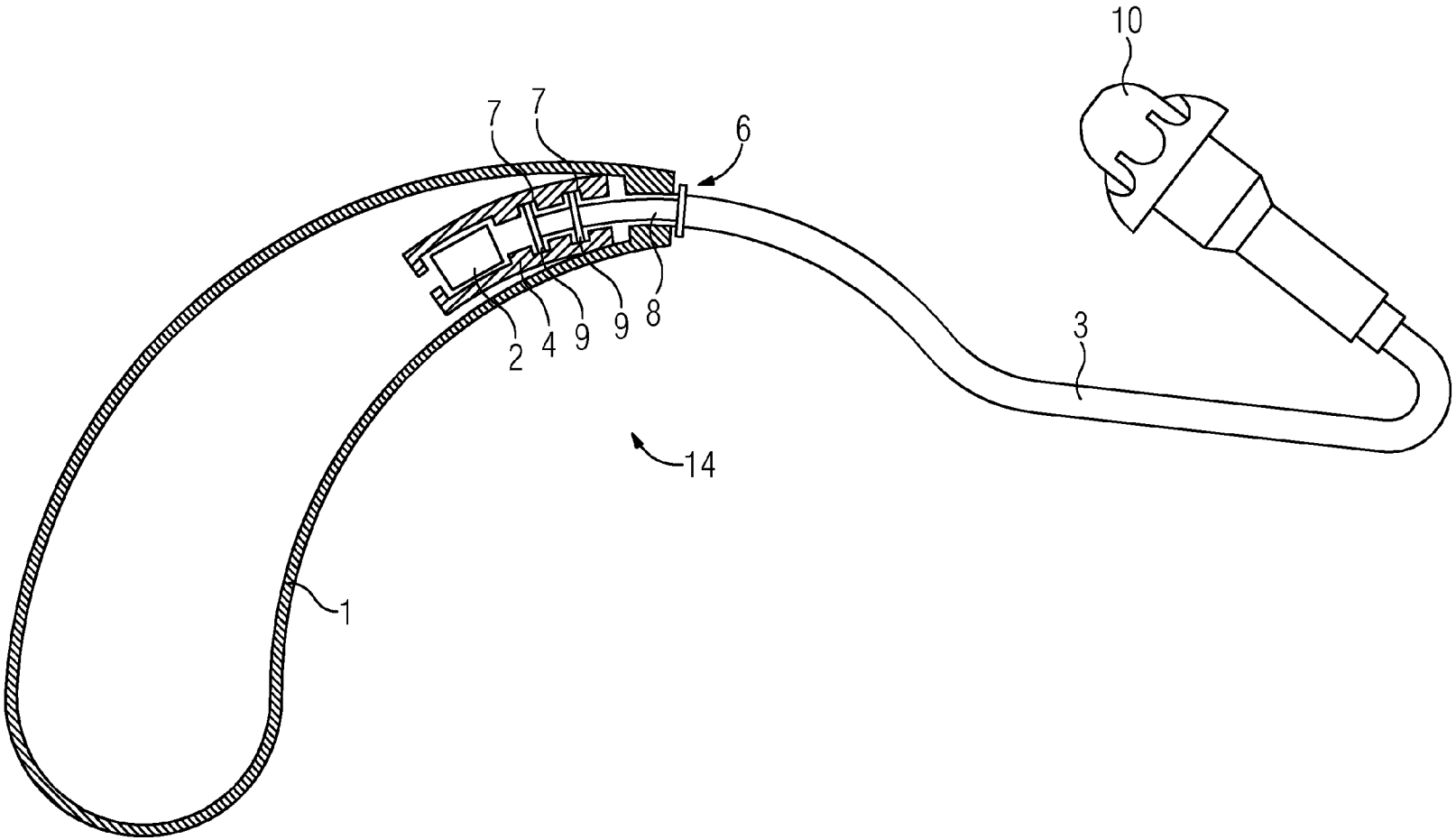
FIG. 4 is a sectional view showing the hearing instrument with the plug-in connection.

FIG. 4 shows a schematic sectional view of a hearing instrument 14 having a plug-in connection to the sound tube 3. The sound tube 3 with the ear-mold 10 is inserted into the socket 6 by its plug 8 at the case end. The circumferential ridges 9 of the plug 8 are locked in the circumferential recesses 7 of the socket 6. The receiver 2 is inserted as explained above. In respect of the mounting insert 4 and plug-in connection, reference is made to the previous explanations.

An advantageous embodiment variant of the invention can be summarized as follows: The invention relates to a hearing instrument, in particular a BTE hearing system, containing the case 1 and the sound tube 3 connected to the case 1 by a plug-in connection, and to a sound tube having a corresponding plug and to a case having a corresponding socket. The object of the invention is to specify a case/tube connection that is simple, easy to assemble, sound-proof, dirt-proof and moisture-proof, and which can be closed and released in an easily reversible manner. The object is achieved by the hearing instrument 14 containing the case 1 in which the receiver 2 is disposed, and the sound tube 3 for conveying output signals of the receiver 2 into an ear canal. Disposed in the case 1 is the mounting insert 4 having the receiver compartment 5 and the socket 6, wherein the receiver 2 is inserted in the receiver compartment 5 and wherein the socket 6 has a circumferential recess 7 or ridge. The sound tube 3 has the plug 8 with the ridge 9 or recess corresponding to the circumferential recess 7 or ridge of the socket 6. The socket 6 and plug 8 can be reversibly interconnected and detached. The inventive mounting insert 4 obviates the need for an additional sound-conducting connecting piece between the receiver 2 and the sound tube 3. This reduces the component count of the hearing instrument 14, thereby reducing the complexity and improving the seal-tightness of the connection between the receiver and the sound tube.

The invention claimed is:

1. A hearing instrument, comprising:

a case;

a receiver disposed in said case;

a sound tube for conveying output signals of said receiver into an ear canal;

a mounting insert disposed in said case, said mounting insert having a receiver compartment, a collar and a socket, wherein said receiver being inserted in said receiver compartment and wherein said socket having one of a circumferential recess or ridge;

said sound tube having a plug with one of a further ridge or further recess corresponding to said circumferential recess or said ridge of said socket, and said socket and said plug configured such that said plug can be inserted into and removed from said socket in a reversible manner; and said case having a holder corresponding to said collar, and said mounting insert is retained in said case by said collar inserted into said holder.

2. The hearing instrument according to claim 1, wherein said mounting insert is of a one-piece design.

3. The hearing instrument according to claim 1, wherein at least one of said plug and said mounting insert is formed at least partly from a flexible material.

4. The hearing instrument according to claim 1, wherein said plug is inserted in said socket and defines a plug-in connection, said plug-in connection formed between said socket and said plug forms a seal for sound in a frequency range audible to a human ear, including in a frequency range from 20 Hz to 20 kHz.

5. The hearing instrument according to claim 1, wherein said mounting insert is configured such that it damps vibrations transmitted from said receiver to said case and vice versa.

6. The hearing instrument according to claim 1, wherein said receiver compartment is configured such that said receiver is retained by said receiver compartment, and in that said receiver can be inserted into and removed from said receiver compartment in a reversible manner.

7. The hearing instrument according to claim 1, wherein said collar is disposed in a region of said socket.

8. The hearing instrument according to claim 1, wherein said plug is produced in one piece with said sound tube by multi-component injection molding or by insert molding.

9. The hearing instrument according to claim 1, wherein:

said plug has at least two said further recesses or two said further ridges; and said socket has at least two said circumferential recesses or two said ridges.

10. A case for a hearing instrument, the case comprising:

a mounting insert having a receiver compartment and a socket, a receiver can be inserted into said receiver compartment, said socket having one of a circumferential recess or a ridge and is implemented such that a sound tube with a plug having a further ridge or further recess corresponding to said circumferential recess or said ridge of said socket can be reversibly inserted into and removed from said socket;

a holder; and said mounting insert having a collar corresponding to said holder, and said mounting insert being retained in the case by said collar inserted in said holder.

11. The case according to claim 10, wherein said mounting insert is of a one-piece design.

12. The case according to claim 10, wherein said mounting insert is formed at least partly from a flexible material.

13. The case according to claim 10, wherein said socket is configured such that, when the plug is inserted in said socket, a plug-in connection formed between said socket and the plug creates a seal for sound in a frequency range audible to a human ear, including in a 20 Hz to 20 kHz range.

14. The case according to claim 10, wherein said mounting insert damps vibrations transmitted from the receiver to the case and vice versa.

15. The case according to claim 10, wherein said receiver compartment is configured such that an inserted receiver is retained by said receiver compartment, and in that the receiver can be reversibly inserted into and removed from said receiver compartment.

16. The case according to claim 10, wherein said collar is disposed in a region of said socket.

17. The case according to claim 10, wherein said socket has at least two of said circumferential recesses or said ridges.

* * * * *